United States Patent [19]

Trautwein

[11] Patent Number: 4,674,677

[45] Date of Patent: Jun. 23, 1987

[54] COLLECTING AND ACCOUNTING APPARATUS FOR EMPTY BOTTLES

[76] Inventor: Hans-Hermann Trautwein, Mergelweg 5, 7302 Ostfildern 2, Fed. Rep. of Germany

[21] Appl. No.: 914,577

[22] Filed: Oct. 3, 1986

Related U.S. Application Data

[63] Continuation of Ser. No. 616,444, Jun. 1, 1984, abandoned.

[30] Foreign Application Priority Data

Jun. 4, 1983 [DE] Fed. Rep. of Germany ..... 3320266

[51] Int. Cl.[4] ..... G07F 7/06; B65D 88/06

[52] U.S. Cl. ..... 232/43.3; 232/43.1

[58] Field of Search ..... 232/43.1, 43.2, 43.3; 220/22.6; 250/223 B; 364/478, 479; 235/93, 98 C

[56] References Cited

U.S. PATENT DOCUMENTS

| | | | |
|---|---|---|---|
| 1,139,436 | 5/1915 | Netter | 232/43.3 |
| 2,296,215 | 9/1942 | Layher | 220/22.6 |
| 2,632,588 | 3/1953 | Hoar, Jr. | 235/98 C |
| 2,696,349 | 12/1954 | Baumstark | 235/93 |
| 3,204,867 | 9/1965 | Wahlbom | 232/43.3 |
| 3,696,236 | 10/1972 | Kus | 364/778 |
| 4,276,467 | 6/1981 | Dubberly et al. | 250/223 B |
| 4,380,316 | 4/1983 | Glinka et al. | 232/43.2 |

FOREIGN PATENT DOCUMENTS

| | | | |
|---|---|---|---|
| 1474874 | 9/1969 | Fed. Rep. of Germany | 232/43.3 |
| 782380 | 9/1957 | United Kingdom | 232/43.3 |

*Primary Examiner*—Robert Peshock
*Assistant Examiner*—John G. Weiss
*Attorney, Agent, or Firm*—Edwin E. Greigg

[57] ABSTRACT

An apparatus that serves to collect and account for empty beverage bottles in beverage stores. A carriage is provided as the receptacle, the bottom of which is automatically displaceable in height by means of a chain drive, operated via light beam emitters and tripping vanes, in accordance with the bottles continually introduced into the receptacle. The bottles, on being introduced, enter an intake rotor having sectors. This rotor alternately changes its direction of rotation after each bottle is introduced, so that the bottles pass into the receptacle in two different directions in alternation via guide chutes. Pyramids of bottles are thereby prevented from forming on one side only. Therefore bottle breakage is avoided as a result of the adaptation of the height of the bottom, and that replacing a full container with an empty one can be accomplished without difficulty. When used with a bottle recognition and evaluation unit, the apparatus can accept bottles and calculate the amount of deposit due.

14 Claims, 3 Drawing Figures

COLLECTING AND ACCOUNTING APPARATUS FOR EMPTY BOTTLES

This is a continuation of copending application Ser. No. 616,444 filed June 1, 1984 now abandoned.

BACKGROUND OF THE INVENTION

The invention relates to an apparatus for collecting empty bottles and making an accounting of them, having an intake zone for feeding single bottles of any arbitrary size into a common receptacle, the bottom of which can be changed from an initial, upper position down to a final, lower position in accordance with the number of bottles that have been placed in the receptacle.

Apparatuses of this kind are intended to promote the re-use of bottles and thus to help save valuable raw materials.

Known apparatuses of this kind have certain disadvantages, however, especially because they require considerable space and are time-consuming to use.

For example, an apparatus according to German laid-open application DE-OS 1 574575 has a receptacle with a bottom that can be lowered, and each time a bottle is placed in the receptacle the bottom is lowered by a specific, predetermined amount. The distance between the bottles in the receptacle and the opening through which the bottles are introduced can become so great, however, that there is a danger of breakage if further bottles are deposited. Emptying the receptacle, which is mounted in a fixed manner in the apparatus, is as complicated as it is time-consuming.

OBJECT AND SUMMARY OF THE INVENTION

These disadvantages are overcome by the invention by embodying the receptacle as a carriage that can be inserted into an outer frame; its bottom is displaceable in height inside the frame by means of a chain drive, and the height of this bottom at a given time can be influenced by means of the uppermost bottle in the receptacle, which touches an end switch for the drive motor of the chain drive.

As a result, breakage of bottles deposited in the receptacle is avoided, and because it is easy to replace a full receptacle with an empty one, the apparatus is substantially simpler to operate.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
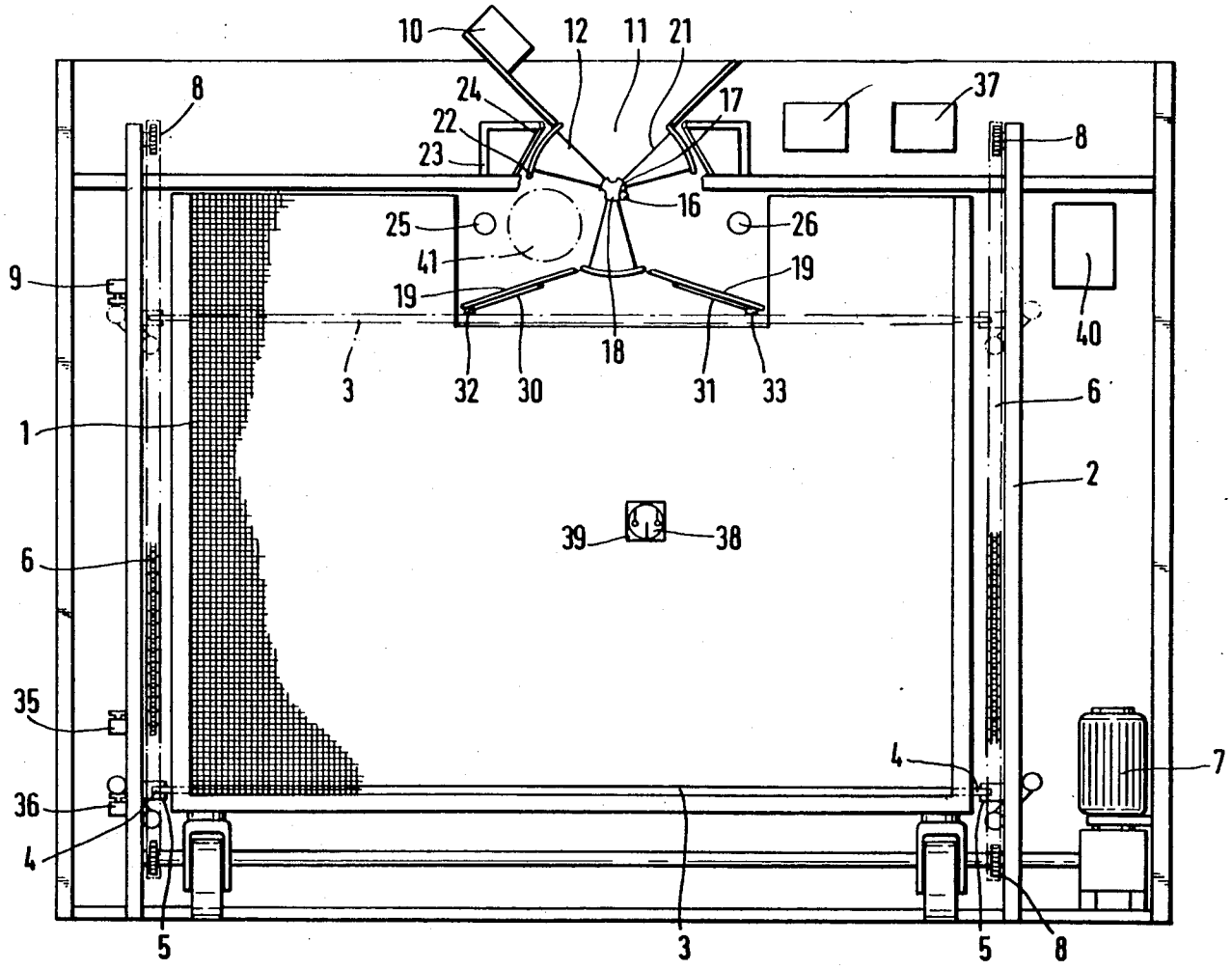
FIG. 1 is a schematic illustration of the apparatus as a whole.
Figure 2:
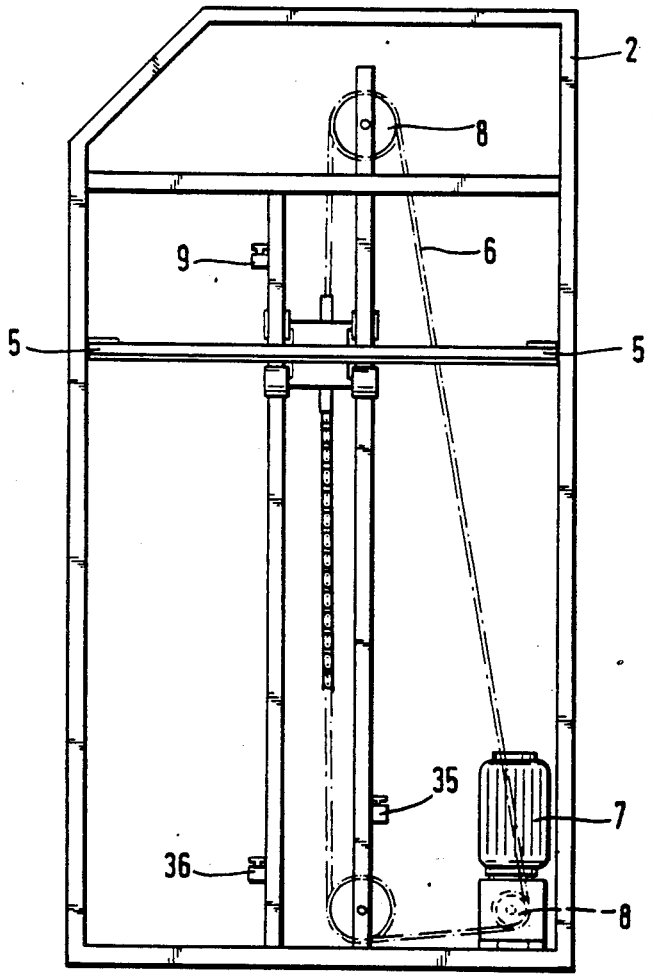
FIG. 2 is a detail of the chain drive for the bottom.
Figure 3:
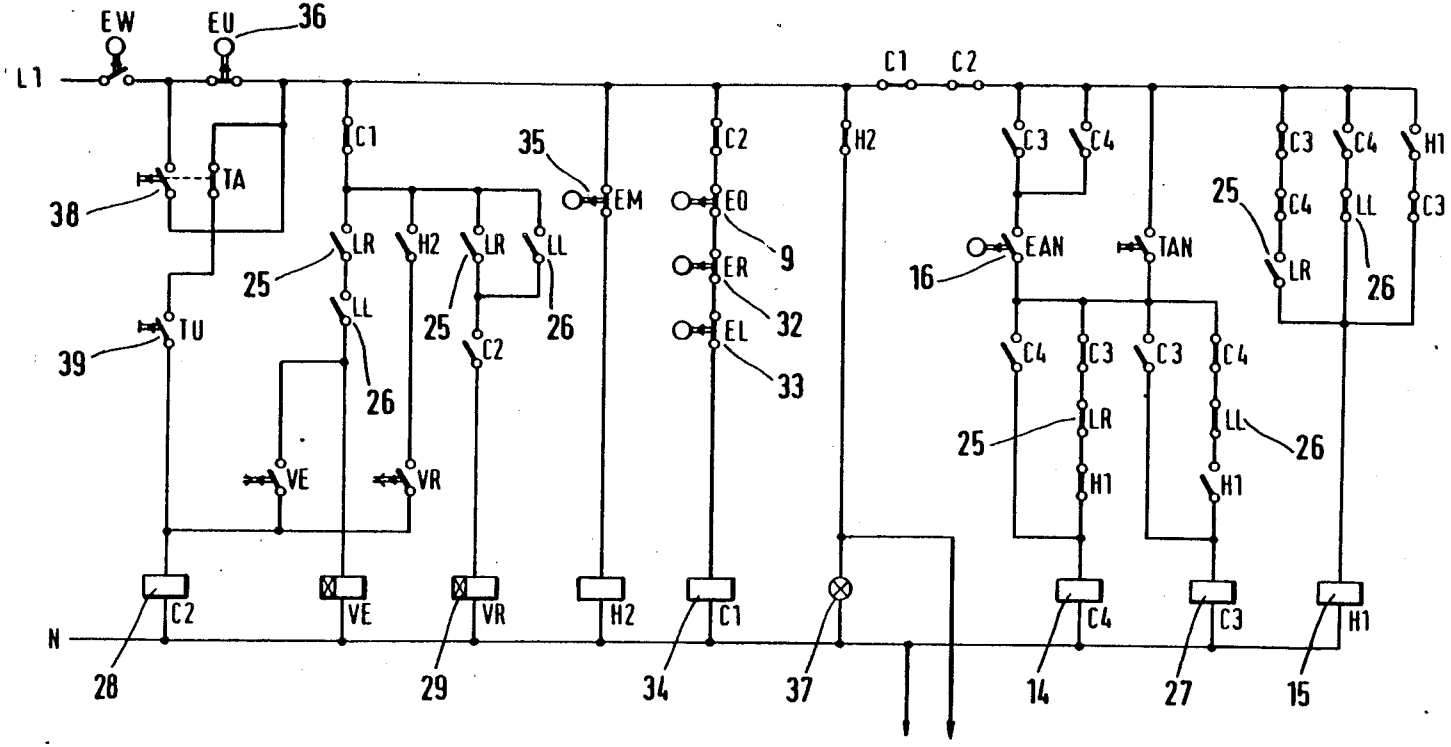
FIG. 3 is a circuit diagram for the apparatus.

A receptacle 1, which is embodied as a carriage, is located in an outer frame or stand 2. A bottom 3 of the receptacle 1 has laterally projecting support tangs 4, which are provided with catches 5 that loosely engage a chain drive 6. A drive motor 7 serves via cog wheels 8 to raise and lower the bottom 3. An upper end switch

9 limits the upward movement of the bottom 3. An ultrasound head 10 serves to ascertain the size and shape of a bottle introduced into an open sector 11 of an intake rotor 12, and the figures defining the size and shape are stored in a computer 13. Via closed relays 14 and 15 or 27 and 15, the intake rotor 12 can be advanced by a motor 41, until the current is interrupted once again by a tripping pin 16, which comes into engagement with a notch 17 of a disc 18 secured on the shaft of the intake rotor 12 in order to open a switch to the circuit of motor 41. At the same time, the direction of rotation of the intake rotor 12 is changed by the introduction of a further empty bottle, so that as the empty bottles slide to the left or right in alternation along chutes 19 they fill the receptacle 1 uniformly, thereby preventing a pyramid of empty bottles from forming and becoming a source of bottle breakage. To promote the passage of the bottles out of the sectors 11 into the receptacle 1, guide lips 22 are disposed on the outer end of the faces 21 defining the sectors 11 and guide flaps 24 are disposed on the housing 23 surrounding the intake rotor 12.

Light beam emitters 25 and 26 that produce a light controlled switch are also disposed on the housing 23, on both sides of the intake rotor 12, and upon the passage of a bottle past them, they emit a corresponding pulse to the computer 13. If a bottle comes to a stop on the bottle chute 19, then one of the light beam emitters 25 or 26 opens the circuit of current to the intake rotor until the bottle chute 19 is again free and the bottle that had been in the way has rolled into the receptacle 1. The intake rotor 12 changes its direction of rotation after each intake of a bottle, under the influence of the relays 14, 27 and 15. During the rotational movement of the intake rotor 12, the relay 15 is shut off via the relay 14 or 27 until such time as the light emitter 25 or 26 is interrupted by a bottle that has come to a stop on the bottle chute 19. If the light beam of emitter 25 is interrupted, the relay 27 can no longer respond, and similarly if the light beam of emitter 26 is interrupted, the relay 14 can no longer respond. The direction of rotation of the intake rotor 12 is then maintained without change until the second light emitter 25 or 26 is interrupted again.

The interruption of the light beam of emitters 25 and 26 simultaneously causes the relay 28 to respond and to put the drive motor 7 into gear and initiate a downward movement of the bottom 3. After the light beam of emitter 25, 26 is released, this downward movement is continued by a time delay relay 29, in order to avoid uncontrolled upward and downward movement.

The relay 28 is connected via the two light beam emitters 25, 26 in series with the delaying relay 29. The duration of the followup time occasioned by the relay 29 during this process is in accordance with the diameter of the largest acceptable empty bottle, plus approximately 15 mm. After this followup time has elapsed, the bottom 3 moves upward again until such time as the uppermost bottle located on the bottom touches one of the two tripping vanes 30 or 31, which act upon end switches 32 or 33 which are disposed under the bottle chutes 19. The appropriate rotational direction of the drive motor 7 from the downward movement via closing of the relay 28 to the upward movement is attained in that after the followup time has elapsed, the relay 28 opens, and the end switches 32 and 33 have been closed by the downward movement that has taken place previously. This, however, causes a relay 34 to close, making the bottom 3 move upward once again until one of the end switches 32 or 33 on the tripping vanes 30 or 31 is opened. Because of this provision, an extremely small distance is attained between the empty bottles already introduced into the receptacle 1 and the bottle chute 19, thereby preventing breakage of the bottles.

Once the receptacle 1 has become almost full of empty bottles and the bottom 3 has been almost completely lowered, a signal is triggered by closing the switch 35, indicating that the now-full receptacle 1 should be replaced with an empty one.

Once the bottom 3 then attains its lower end position, the control system becomes voltage-free or completely turned off by means of an end switch 36 which opens the main circuit, and a corresponding signal appears at a display element 37, indicating that the bottle intake has been blocked off.

A closure of a switch 38 via a door lock 39 causes the drive motor 7 to operate, even if the end switch 36 should not yet be closed, and the relay 28 then takes precedence in operating the motor until the end switch 36 is reached. As a result it is assured that after a door in a housing (not otherwise shown) is opened, the bottom 3 will always be in its lowermost end position.

The empty bottle collecting and accounting apparatus can be added onto by providing that the figures ascertained by the computer 13 be transmitted to a printer 40, which ascertains the amount of the bottle deposit that is to be expected and immediately imparts this information.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for collecting empty bottles having a receptacle fillable from an upper zone via an intake, said receptacle being embodied as a carriage having a bottom movable incrementally from an upper initial position to a lower final position via a motor drive mechanism triggerable by a level-scanning device disposed in the intake, said movement being adapted to occur as a function of a quantity of empty bottles reaching the receptacle, characterized in that said apparatus includes a stationary housing provided with said motor drive mechanism, the level-scanning device and a storage space for temporarily holding the receptacle carriage; that said motor drive mechanism has at least one catch that can be releasably coupled with the bottom of the receptacle upon introduction of the receptacle carriage within said stationary housing into a pre-set position; said stationary housing being provided with a feed mechanism in a top portion thereof for feeding in single bottles leading to the intake of the receptacle carriage; said feed mechanism having two bottle chutes oriented in opposite directions into the intake of the receptacle, said bottle chutes being adapted to receive the empty bottles in alternation; and that above each of said bottle chutes, a respective light barrier means is disposed, which is arranged to respond selectively to empty bottles that move past it and to empty bottles that have come to a stop, thus triggering at least one of a change of bottle feed direction and the lowering of said receptacle.

2. An apparatus as defined by claim 1, further characterized in that the bottom has supporting tangs laterally protruding beyond the receptacle, which are adapted to be releasably coupled with said catches on the drive mechanism.

3. An apparatus as defined by claim 1, further characterized in that said feed mechanism has an intake rotor including sectors for receiving single bottles and further has a bottle-scanning device responsive to size and shape of the empty bottles fed in.

4. An apparatus as defined by claim 3, further characterized in that the bottle-scanning device is associated with a computer means for evaluating and storing the shape and size values ascertained thereby.

5. An apparatus as defined by claim 4, further characterized in that the bottle-scanning device comprises an ultrasound head.

6. An apparatus as defined by claim 3, further characterized in that the direction of rotation of the intake rotor is alternatingly reversible, and that depending upon the direction of rotation of the intake rotor one or the other bottle chute can be supplied with an empty bottle.

7. An apparatus as defined by claim 3, further characterized in that the light barrier means on the one hand furnish a pulse to a computer means in response to a bottle moving past them and, on the other hand, by means of an additional pulse, vary the direction of rotation of the intake rotor, as long as there is no bottle that has stopped on a bottle chute which interrupts one of the light barrier means.

8. An apparatus as defined by claim 7, further characterized in that when the light barrier means is interrupted by a bottle sliding over the bottle chute, lowering of the receptacle bottom can be initiated via a delaying relay until the light barrier means is again uninterrupted, and that subsequently, after traversal of a preset distance, the receptacle bottom can be raised once again.

9. An apparatus as defined by claim 3, further characterized in that a disc provided with indexing notches is disposed on a shaft of the intake rotor, the indexing notches being engaged by a tripping pin that limits rotation of the disc and reverses the direction of rotation of the intake rotor.

10. An empty bottle collecting and accounting apparatus as defined by claim 9, further characterized in that after every stop effected by the tripping pin in the indexing notch, the subsequent direction of said rotation disc is changed each time another empty bottle is accepted, so that the empty bottles which therefore slide in alternation down opposite bottle chutes fill the receptacle uniformly.

11. An empty bottle collecting and accounting apparatus as defined by claim 10, in which said sectors include guide lips on their outer ends, and guide flaps disposed on said housing surrounding said intake rotor.

12. An empty bottle collecting and accounting apparatus as defined by claim 8, further characterized in that an upward movement of the bottom is controlled by switches disposed on tripping vanes which are disposed on the underside of the bottle chutes.

13. An empty bottle collecting and accounting apparatus as defined by claim 12, characterized in that a signal switch is provided, which indicates a full receptacle shortly before actuation of a lower, end switch.

14. An empty bottle collecting and accounting apparatus as defined by claim 8, further characterized in that a door lock switch is provided on the housing, which by opening said door said drive motor is simultaneously operated to move the bottom into a lower final position and by closing said door said drive motor operates said drive to move the bottom into an upper final position.

* * * * *